US011744352B1

(12) United States Patent
Chambers

(10) Patent No.: US 11,744,352 B1
(45) Date of Patent: Sep. 5, 2023

(54) BELT-ATTACHED ITEM HOLDER

(71) Applicant: Glyn Robert Chambers, Granbury, TX (US)

(72) Inventor: Glyn Robert Chambers, Granbury, TX (US)

( * ) Notice: Subject to any disclaimer, the term of this patent is extended or adjusted under 35 U.S.C. 154(b) by 0 days.

(21) Appl. No.: 17/699,107

(22) Filed: Mar. 19, 2022

Related U.S. Application Data

(63) Continuation-in-part of application No. 29/821,239, filed on Dec. 28, 2021.

(51) Int. Cl.
*A45F 5/02* (2006.01)

(52) U.S. Cl.
CPC ..... *A45F 5/021* (2013.01); *A45F 2200/0575* (2013.01)

(58) Field of Classification Search
CPC ..... A45F 2005/026; A45F 2200/0575; A45F 5/021
USPC ..... 224/255–256, 269, 271–272
See application file for complete search history.

(56) References Cited

U.S. PATENT DOCUMENTS 4,419,794 A * 12/1983 Horton, Jr. ..... A45F 5/02 24/669
4,917,281 A 4/1990 Ostermiller
5,054,170 A 10/1991 Otrusina
5,450,994 A * 9/1995 Malinowski ..... A45F 5/02 224/904
5,511,705 A 4/1996 Dreszer
5,799,847 A * 9/1998 Sandor ..... A45F 5/02 224/904
5,915,610 A 6/1999 Russell
6,318,610 B1 11/2001 Doherty
6,325,577 B1 12/2001 Anderson
6,641,011 B1 11/2003 Kahn
6,655,560 B2 12/2003 Kahn
6,848,605 B2 2/2005 Dillenberger
6,880,794 B1 4/2005 Kahn
6,994,238 B2 2/2006 Estabaya
7,143,841 B2 12/2006 Etter
7,216,788 B2 * 5/2007 Blechman ..... B25H 3/006 224/269
7,314,153 B2 1/2008 Musarella
D567,615 S 4/2008 Taniguchi
7,802,706 B1 9/2010 Selsor
7,819,370 B2 10/2010 Ho
8,141,210 B2 * 3/2012 Colorado ..... A45F 5/021 24/3.12
D691,444 S 10/2013 Tirone
(Continued)

*Primary Examiner* — Adam J Waggenspack
(74) *Attorney, Agent, or Firm* — QUICKPATENTS, LLC; Kevin Prince

(57) ABSTRACT

A holder for a tool of the type having a belt clip includes a rigid base having a front side, a rear side, a top edge, a bottom edge, and two side edges. At least one rigid belt loop is fixed with the rear side of the rigid base and is open therethrough between side edges thereof for receiving a belt of a person. A rigid front panel is held away from the front side of the rigid base by at least two vertical standoffs. The rigid front panel includes a cut-out portion adapted to receive the belt clip of the tool therein. In use, with the rigid base fixed with the person's belt, the belt clip of the tool is positioned within the cut-out portion of the rigid front panel and then lowered until the belt clip is retained between the rigid front panel and the rigid base.

10 Claims, 6 Drawing Sheets

(56) References Cited

U.S. PATENT DOCUMENTS

| | | | | |
|---|---|---|---|---|
| 8,777,077 | B2 | 7/2014 | McClain | |
| 9,101,189 | B2 | 8/2015 | Vuckov | |
| 10,051,948 | B2 | 8/2018 | Carver | |
| 10,258,136 | B2 | 4/2019 | Fiorello | |
| 10,531,724 | B2 | 1/2020 | Woodhams | |
| 2002/0008128 | A1 | 1/2002 | Field | |
| 2004/0050888 | A1 | 3/2004 | Warner | |
| 2004/0115525 | A1 | 6/2004 | Kuo | |
| 2004/0226174 | A1 | 11/2004 | Etter | |
| 2005/0011919 | A1 | 1/2005 | Durham | |
| 2006/0104735 | A1 | 5/2006 | Zeiler | |
| 2007/0023471 | A1* | 2/2007 | Garcia | B25H 3/006 224/904 |
| 2007/0125565 | A1 | 6/2007 | Etter | |
| 2007/0228093 | A1 | 10/2007 | Durham | |
| 2007/0284405 | A1 | 12/2007 | Prevost | |
| 2008/0000939 | A1 | 1/2008 | Walsh | |
| 2008/0277546 | A1 | 11/2008 | Kahn | |
| 2009/0145938 | A1 | 6/2009 | Kahn | |
| 2009/0242598 | A1 | 10/2009 | Dormaar | |
| 2010/0044405 | A1* | 2/2010 | Albert | F41C 33/041 224/678 |
| 2010/0294822 | A1* | 11/2010 | Haight | F41C 33/041 224/666 |
| 2010/0327029 | A1 | 12/2010 | Kahn | |
| 2014/0097217 | A1 | 4/2014 | Walsh | |
| 2014/0291362 | A1* | 10/2014 | Victor | A45F 5/00 224/222 |
| 2015/0122856 | A1 | 5/2015 | Pecotte | |
| 2019/0104830 | A1* | 4/2019 | Cortellacci | A45F 5/00 |
| 2021/0023690 | A1 | 1/2021 | Lachica Koch | |
| 2022/0045458 | A1* | 2/2022 | Wu | F16B 21/02 |

* cited by examiner

BELT-ATTACHED ITEM HOLDER

CROSS-REFERENCE TO RELATED APPLICATIONS

This application is a continuation-in-part of U.S. Design patent application Ser. No. 29/821,239, filed on Dec. 28, 2021, and is incorporated herein by reference.

STATEMENT REGARDING FEDERALLY SPONSORED RESEARCH AND DEVELOPMENT

Not Applicable.

FIELD OF THE INVENTION

This invention relates to tool holders, and more particularly to a tool holder for use on a person's belt.

BACKGROUND

Tools of all types often include a belt clip or special receiver for attachment to a tool belt, a regular belt, or the like. A craftsman having a wide variety of tools can find himself with a plurality of different belt clips, holders, pockets, boxes, or hooks attached to either their belt, tool belt, tool box, or the like. Not all such tools are needed for every job or task, so often the craftsman carries multiple tool receivers unnecessarily.

Therefore, there is a need for a device that can receive and carry one of many different tools or devices. Such a needed device would be ambidextrous in that it could be positioned on the person's belt either on his left side or his right side, as desired. Such a needed invention would be intuitive to use and would only require a minimal natural hand motion to effectively use. The needed device would be relatively inexpensive to manufacture. The present invention accomplishes these objectives.

SUMMARY OF THE INVENTION

The present device is a holder for a tool of the type having a belt clip, such as a drill or the like. Such a belt clip typically is made to engage a belt of a person, but often such belt clips are cumbersome to use and do not engage the belt easily when the person has a shirt or jacket that can interfere.

The holder includes a rigid base that has a front side, a rear side, a top edge, a bottom edge, and two side edges. At least one rigid belt loop is fixed with the rear side of the rigid base and is open therethrough between side edges thereof. An opening is formed through each rigid belt loop from side to side, through which the belt can traverse.

Preferably the at least one rigid belt loop is exactly two rigid belt loops, one disposed along each of the side edges of the rigid base.

A rigid front panel is held away from the front side of the rigid base by at least two vertical standoffs that are each fixed to the rigid front panel proximate the side edges thereof. The rigid front panel includes a cut-out portion adapted to receive the belt clip of the tool therein. Preferably the cut-out portion includes a V-shaped (alternatively described as a trapezoid-shaped) cut-out combined with a trapezoid-shaped (alternatively described as a second trapezoid-shaped) cut-out at an apex of the V-shaped cut-out, thereby forming a waist through which the belt clip of the tool can pass.

In the words of the said alternative description, having a first trapezoid-shaped cut-out above the second trapezoid-shaped cut-out, the short side of the top trapezoid is meeting, or abutting, the short side of the bottom trapezoid by narrowing to a waist between them. The waist is sized to accommodate the belt clip when slightly angled with respect to the top edge of the rigid base, by natural hand motion, so that the tool does not inadvertently dislodge from the holder but rather must be purposefully removed by the person. This increases the safety of the holder during use.

In use, with the rigid base fixed with the belt worn by the person, the belt clip of the tool can be positioned within the cut-out portion of the rigid front panel, pressing against the front side of the rigid base, and then lowered until the belt clip is retained between the rigid front panel and the rigid base. The vertical standoffs that separate the rigid front panel from the rigid base are at least as thick as the portion of the belt clip that slides between the rigid front panel and the rigid base.

Preferably the rigid base, each rigid belt loop, and the rigid front panel are made from the same material in an integrally formed device out of a plastic injection molded or milled material. Alternately the holder may be made from a machined or cast metal material.

In alternate embodiments, the holder is made from separate pieces, preferably of a laser-cut plastic, wood, or metal sheet material. In such an embodiment, each rigid belt loop comprises a vertical cross member and at least two horizontal standoffs, such that each horizontal standoff is fixed with the rear side of the rigid base, and such that each vertical cross member is fixed across both horizontal standoffs to form the opening through which the belt traverses. The vertical cross members, horizontal standoffs, rigid front panel, and vertical standoffs are each fixed with the rigid base with one or more mechanical fasteners, which preferably include a screw and a cooperative nut. Such a nut is preferably flush against the rigid front panel for improved aesthetics.

The present invention is a device that can receive and carry one of many different tools or devices. The present device is ambidextrous in that it can be positioned on the person's belt either on his left side or his right side, as desired. The present invention is intuitive to use and only requires a minimal natural hand motion to effectively use. The present device is relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
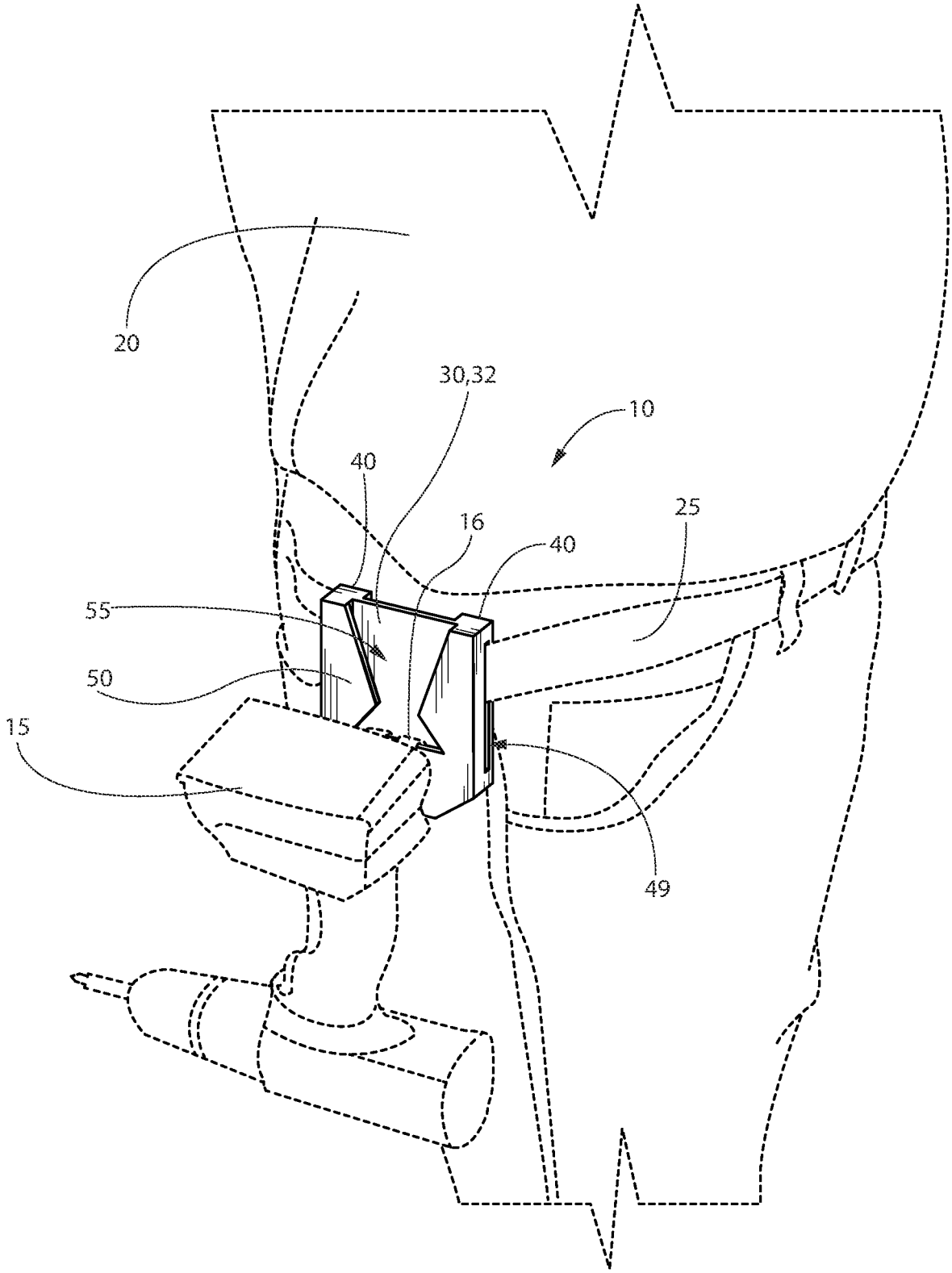
FIG. 1 is a perspective view of a first embodiment of the invention, illustrated in-use as worn by a person on his belt and holding a tool at a belt clip thereof.
Figure 2:
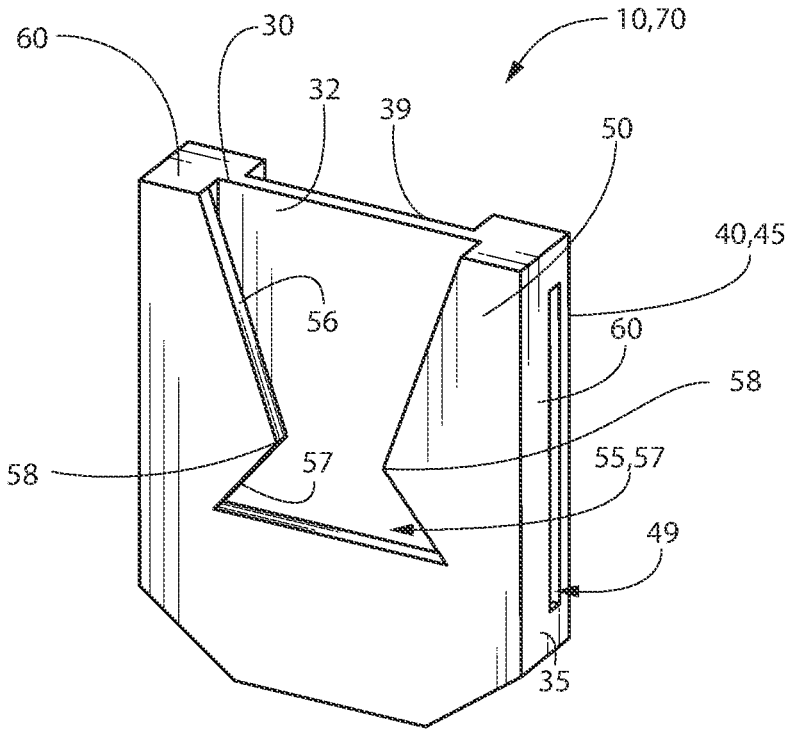
FIG. 2 is a front perspective view of the invention of FIG. 1.
Figure 3:
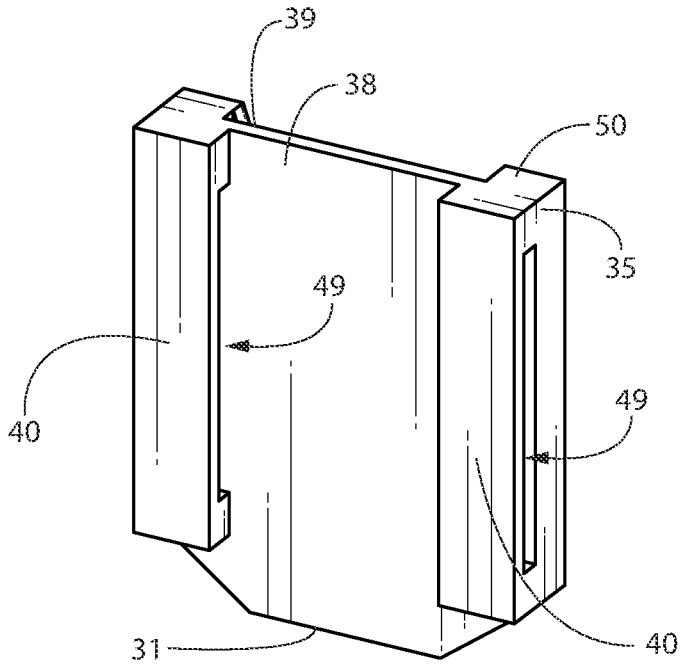
FIG. 3 is a rear perspective view thereof.
Figure 4:
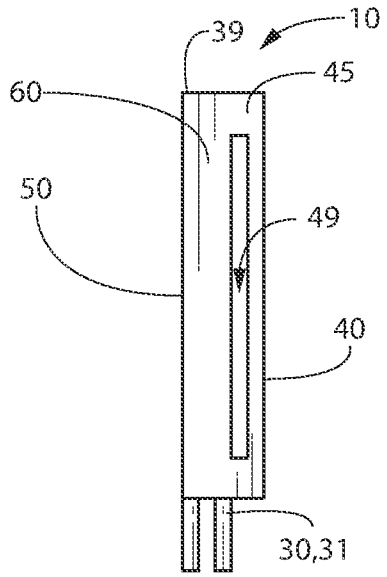
FIG. 4 is a right-side elevational view thereof.
Figure 5:
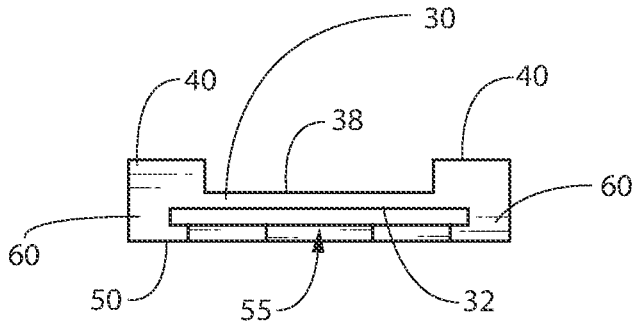
FIG. 5 is a top plan view thereof.
Figure 6:
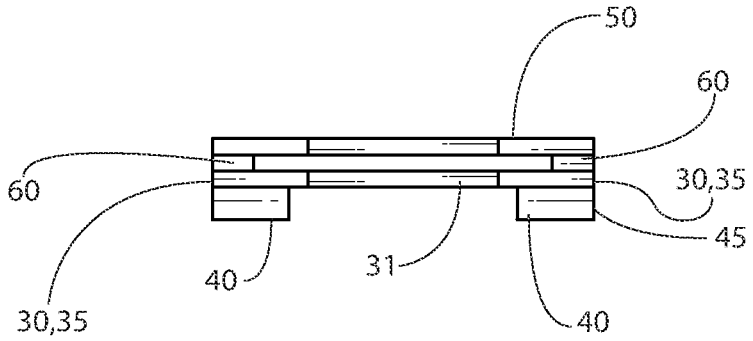
FIG. 6 is a bottom plan view thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-6 illustrate a holder 10 for a tool 15 of the type having a belt clip 16, such as a drill or the like. Such a belt clip 16 typically is made to engage a belt 25 of a person 20, but often such belt clips 16 are cumbersome to use and do not engage the belt 25 easily when the person 20 has only one hand free, a shirt or jacket that can interfere, etc.

The holder 10 includes a rigid base 30 that has a front side 32, a rear side 38, a top edge 39, a bottom edge 31, and two side edges 35.

At least one rigid belt loop 40 is fixed with the rear side 38 of the rigid base 30 and is open therethrough between side edges 45 thereof. An opening 49 is formed through each rigid belt loop 40 from side to side, through which the belt 25 can traverse. Preferably the at least one rigid belt loop 40 is exactly two rigid belt loops 40, one disposed along each of the side edges 35 of the rigid base 30.

A rigid front panel 50 is held away from the front side 32 of the rigid base 30 by at least two vertical standoffs 60 that are each fixed to the rigid front panel 50 proximate the side edges 35 thereof. The rigid front panel 50 includes a cut-out portion 55 adapted to receive the belt clip 16 of the tool 15 therein. Preferably the cut-out portion 55 includes a V-shaped (or first trapezoidal) cut-out 56 combined with a trapezoid-shaped cut-out 57 at an apex of the V-shaped (or first trapezoidal) cut-out 56, thereby forming a waist 58 through which the belt clip 16 of the tool 15 can pass. The waist 58 is sized to accommodate the belt clip 16 when slightly angled in a natural hand motion with respect to the top edge 39 of the rigid base 30, so that the tool 15 does not inadvertently dislodge from the holder 10 but rather must be purposefully removed by the person 20.

In use, with the rigid base 30 fixed with the belt 25 worn by the person 20, the belt clip 16 of the tool 15 can be positioned within the cut-out portion 55 of the rigid front panel 50, pressing against the front side 32 of the rigid base 30, and then lowered until the belt clip 16 is retained between the rigid front panel 50 and the rigid base 30. The vertical standoffs 60 that separate the rigid front panel 50 from the rigid base 30 are at least as thick as the portion of the belt clip 16 that slides between the rigid front panel 50 and the rigid base 30.

Preferably the rigid base 30, each rigid belt loop 40, and the rigid front panel 50 are made from the same material in an integrally formed device 70 out of a plastic injection molded or milled material. Alternately the holder 10 may be made from a machined or cast metal material.

Figure 7:
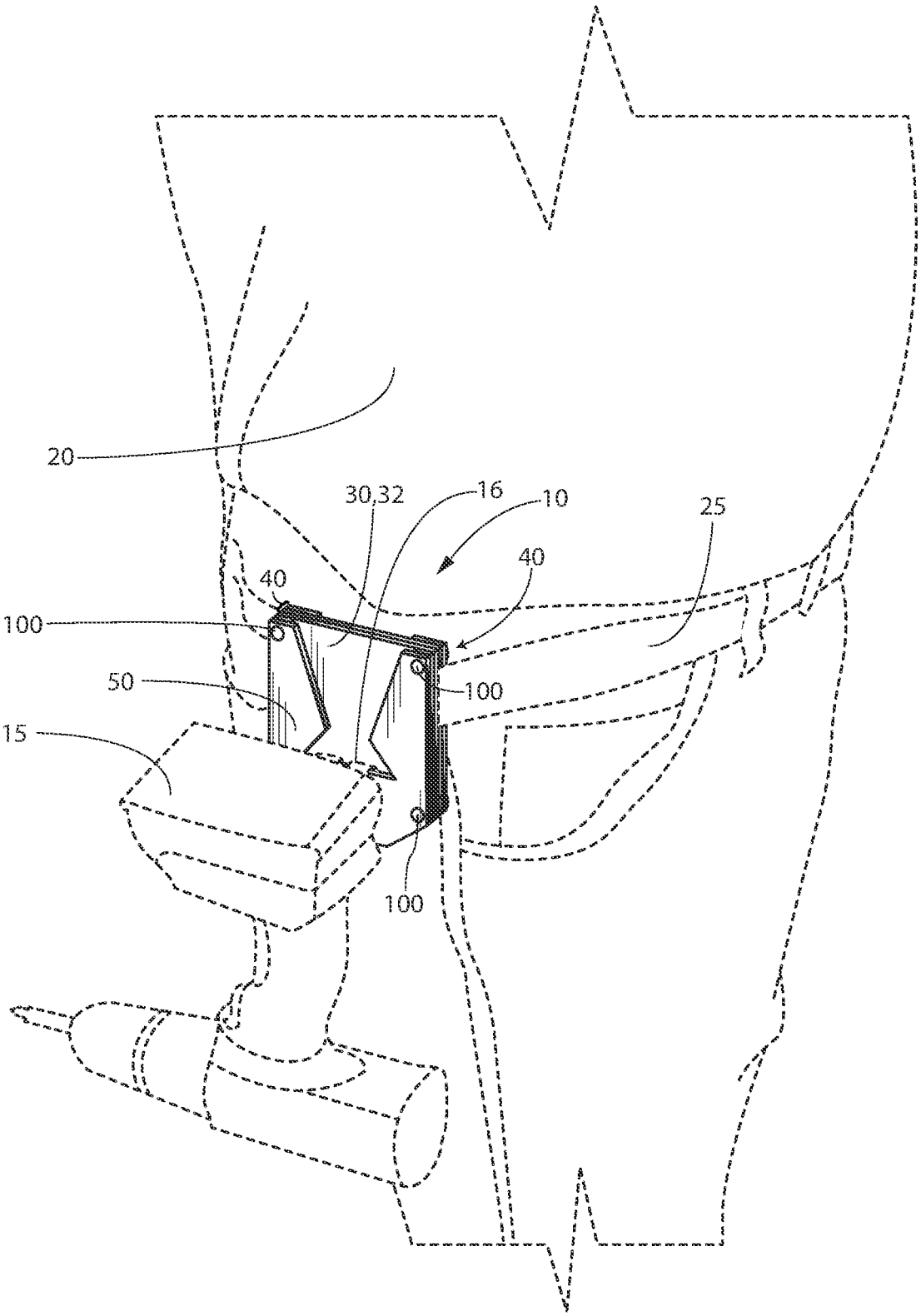
FIG. 7 is a perspective view of a second embodiment of the invention, illustrated in use as worn by the person on his belt and holding the tool at the belt clip thereof.
Figure 8:
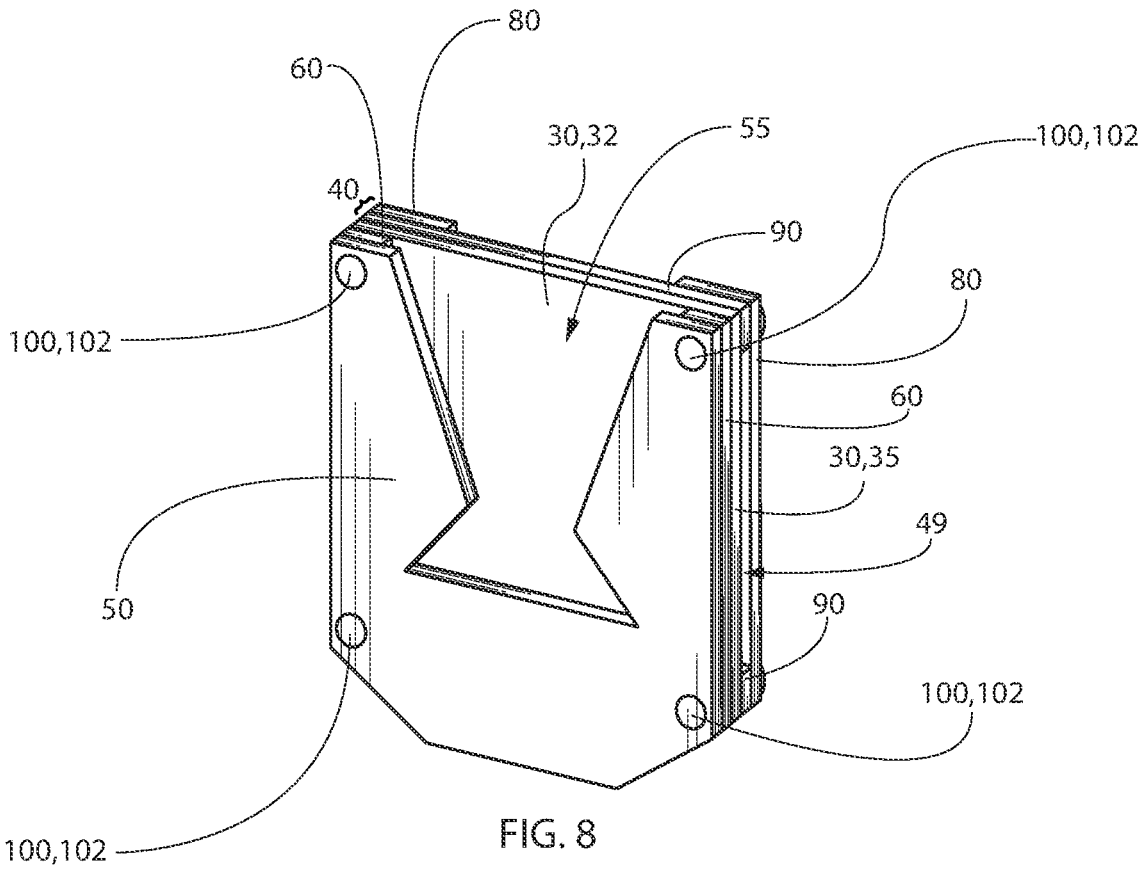
FIG. 8 is a front perspective view of the embodiment of FIG. 7.
Figure 9:
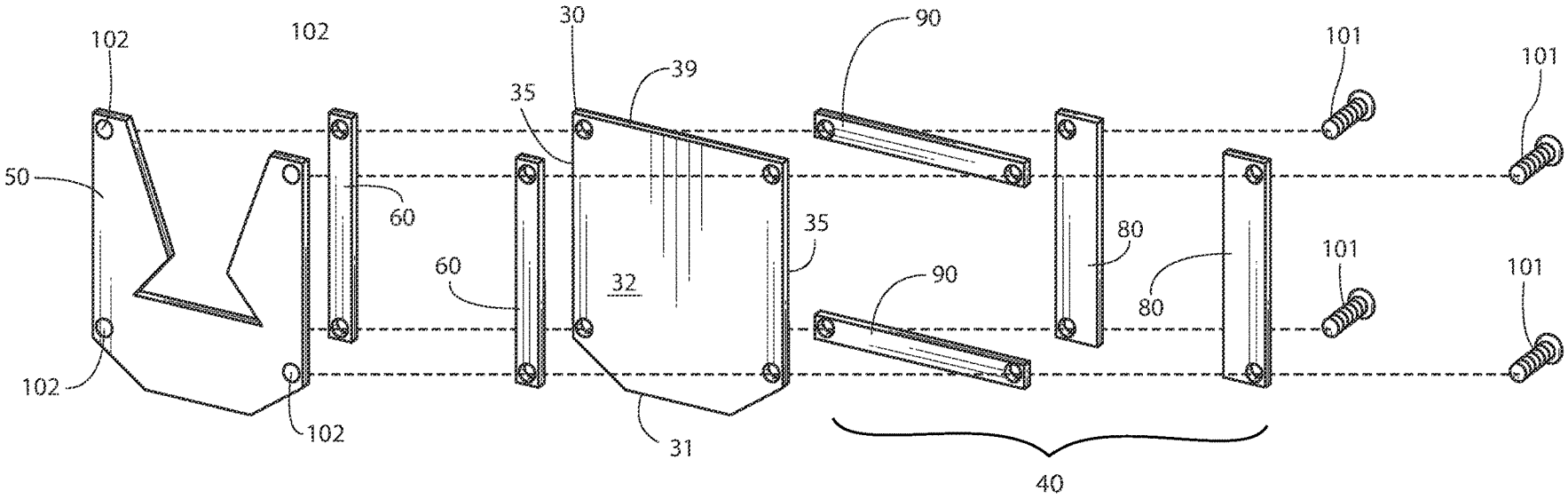
FIG. 9 is an exploded perspective view of the embodiment of FIG. 7.

In alternate embodiments, the holder 10 is made from separate pieces, preferably of a laser-cut plastic, wood, or metal sheet material (FIGS. 7-9). In such an embodiment, the rigid belt loops 40 comprises two vertical cross member 80 and two horizontal standoffs 90, such that each horizontal standoff 90 is fixed with the rear side 38 of the rigid base 30, and such that each vertical cross member 80 is fixed across both horizontal standoffs 90 to form the opening 49 through which the belt 25 traverses. The vertical cross members 80, horizontal standoffs 90, rigid front panel 50, and vertical standoffs 60 are each fixed with the rigid base 30 with one or more mechanical fasteners 100, which preferably include a screw 101 and a cooperative nut 102. Such a nut 102 is preferably flush against the rigid front panel 50 for improved aesthetics.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A holder for a tool of the type having a belt clip, the holder for cooperating with a belt of a person, comprising:

a belt clip a rigid base having a front side, a rear side, a top edge, a bottom edge, and two side edges;

at least one rigid belt loop fixed with the rear side of the rigid base and open therethrough between side edges thereof, forming at least one opening through which the belt can traverse;

a rigid front panel held away from the front side of the rigid base by at least two vertical standoffs fixed to the rigid front panel proximate the side edges thereof, the rigid front panel including a cut-out portion adapted to receive the belt clip of the tool therein, wherein:

the cut-out portion includes at least a first trapezoid-shaped cut-out whose widest edge is along the top edge of the rigid front panel cut-out and at least a second trapezoid-shaped cut-out whose least wide edge meets with the least wide edge of the first trapezoid shaped cut-out and having a solid structure at its base defining its widest edge; and whereby with the rigid base fixed with the belt worn by the person, the belt clip of the tool is positioned within the cut-out portion of the rigid front panel and lowered until the belt clip is retained between the rigid front panel and the rigid base.

2. The holder of claim 1 comprising a construction of only straight edges, without curved corners or curved edges, constructed to adapt to a standard tool clip.

3. The holder of claim 1 wherein the at least one rigid belt loop is exactly two rigid belt loops, each fixed at one of the side edges of the rigid base.

4. The holder of claim 1 wherein the rigid base, at least one rigid belt loop, and the rigid front panel are all integrally formed.

5. The holder of claim 4 wherein the holder is made from a rigid plastic material.

6. The holder of claim 4 wherein the holder is formed from a milled metallic material.

7. The holder of claim 4 wherein the holder is formed from a cast metallic material.

8. The holder of claim 1 wherein the at least one rigid belt loop comprises two vertical cross members and at least two horizontal standoffs, wherein each horizontal standoff is fixed with the rear side of the rigid base, and wherein each vertical cross member is fixed across both horizontal standoffs to form the at least one opening through which the belt traverses.

9. The holder of claim 8 wherein the vertical cross members, horizontal standoffs, front panel, and vertical standoffs are each fixed to the rigid base with one or more mechanical fasteners.

10. The holder of claim 9 wherein the one or more mechanical fasteners include a screw and a nut.

* * * * *